US007546666B2

(12) United States Patent
Malchow

(10) Patent No.: US 7,546,666 B2
(45) Date of Patent: Jun. 16, 2009

(54) RETRACTABLE CONNECTION AND SEAL BETWEEN CONTAINERS OF A DEVICE FOR HOLDING FREIGHT

(76) Inventor: Ulrich Malchow, Frahmstrasse 9, 22587 Hamburg (DE)

( * ) Notice: Subject to any disclaimer, the term of this patent is extended or adjusted under 35 U.S.C. 154(b) by 456 days.

(21) Appl. No.: 11/174,006

(22) Filed: Jun. 30, 2005

(65) Prior Publication Data

US 2006/0011623 A1 Jan. 19, 2006

(30) Foreign Application Priority Data

Jun. 30, 2004 (DE) ..... 10 2004 031 466

(51) Int. Cl.
*B65D 88/02* (2006.01)
*B65D 88/12* (2006.01)

(52) U.S. Cl. ..... 24/287; 220/1.5; 220/23.2; 220/23.4; 206/504; 277/939

(58) Field of Classification Search ..... 220/1.5, 220/1.6, 23.2, 23.4; 206/503, 504; 24/287; 277/939
See application file for complete search history.

(56) References Cited

U.S. PATENT DOCUMENTS

| | | | | | |
|---|---|---|---|---|---|
| 2,972,175 | A * | 2/1961 | Abolins | 411/349 |
| 3,052,941 | A * | 9/1962 | Abolins et al. | 24/287 |
| 3,061,134 | A * | 10/1962 | Fesmire et al. | 220/1.5 |
| 3,162,320 | A * | 12/1964 | Hitch et al. | 220/23.4 |
| 3,261,070 | A * | 7/1966 | Abolins | 24/287 |
| 3,294,420 | A * | 12/1966 | Martin | 280/418.1 |
| 3,746,377 | A * | 7/1973 | de Neveu et al. | 24/287 |
| 3,749,273 | A * | 7/1973 | Wreghitt et al. | 220/1.5 |
| 3,966,075 | A * | 6/1976 | Schultz | 220/1.5 |
| 4,108,326 | A * | 8/1978 | Bertolini | 220/1.5 |
| 4,510,714 | A * | 4/1985 | Kasper et al. | 49/249 |
| 4,729,707 | A * | 3/1988 | Takahashi | 411/389 |
| 4,819,820 | A * | 4/1989 | Weiner | 220/1.5 |
| 5,462,188 | A * | 10/1995 | Yurgevich | 220/1.5 |
| 6,269,963 | B1 * | 8/2001 | Hall | 220/1.5 |
| 6,363,586 | B1 * | 4/2002 | Neufingerl | 24/287 |
| 6,669,395 | B2 * | 12/2003 | Wu | 403/286 |
| 2004/0222220 | A1 * | 11/2004 | DeWinter | 220/1.5 |

FOREIGN PATENT DOCUMENTS

| | | |
|---|---|---|
| DE | 4329355 A1 * | 3/1995 |
| DE | 200 05 214 | 9/2000 |
| WO | 87/04994 | 8/1987 |
| WO | 98/06644 | 2/1998 |

* cited by examiner

*Primary Examiner*—Anthony D Stashick
*Assistant Examiner*—Ned A Walker
(74) *Attorney, Agent, or Firm*—Friedrich Kueffner

(57) ABSTRACT

A device for holding freight is composed of two containers, which are connected to each other by at least two connecting elements. The area where the containers are connected to each other is sealed off from the environment by at least one sealing element. Each container has a closable access opening at the end which faces the other container. The sealing element extends around the area of the outside edges of the two facing ends of the containers. The connecting element is installed on the containers in such a way that, when the containers are not connected to each other, an external contour of the connecting element is essentially in an interior position with respect to the external contour of the container.

22 Claims, 13 Drawing Sheets

RETRACTABLE CONNECTION AND SEAL BETWEEN CONTAINERS OF A DEVICE FOR HOLDING FREIGHT

BACKGROUND OF THE INVENTION

1. Field of the Invention

The invention relates to a device consisting of two containers for holding freight, the containers being connected to each other by at least two connecting elements and sealed off against the environment in the area where they are connected by at least one sealing element, wherein each container has a closable access opening at the end which faces the other container.

2. Description of the Related Art

So-called 20-foot containers and 40-foot containers are often used for the transport of freight. The containers are transported on land, on the sea, and in the air. The requirements on container size applicable in a specific case differ considerably from one transfer point to another. It happens frequently that small containers are required in one transport direction and large containers in the opposite transport direction. As a result, it is often necessary to transport empty containers back in the opposite direction to their point of origin.

To avoid the need to transport empty containers back to where they came from, it has already been proposed in DE 43 29 355 that smaller containers be designed so that they can be connected to each other. This means that the smaller containers can either be used individually or combined with each other to form larger containers.

The principle of connecting containers together, according to which two 20-foot containers can be connected to form a 40-foot container, has thus already been described in DE 43 29 355. These previously described basic possibilities of connecting containers together, however, are not yet able to provide a sufficiently low-cost, easy-to-handle, and yet sturdy design which can withstand the transport loads to which containers are subject.

SUMMARY OF THE INVENTION

The object of the present invention is therefore to make available a device of the type described above in such a way that both ease of handling and high reliability are provided while manufacturing costs are kept low at the same time.

This object is met according to the invention in that the sealing element extends around the area of the outside edges where the two ends of the containers face each other, and in that the connecting element is installed on the container in such a way that, when the containers are not attached to each other, the external contour of the connecting element is located in an essentially interior position with respect to the external contour of the container.

Because the sealing element is installed around the edges, a functional seal is ensured. Because only one component must be handled and fitted into position, furthermore, the seal can be handled much more easily during the connecting and disconnecting operations. The connecting elements are arranged in such a way that, when not in use, they are essentially recessed below the external contour of the containers. This also contributes to the ease of handling, because there are no components present which project out from the container. There is therefore no danger that an unused connecting element could be broken off or that a projecting connecting element could cause damage to other containers. Thus it is also guaranteed that the inventive device can meet the requirements of the ISO standards for containers. When the containers are disconnected from each other, therefore, the sealing element is removed from the containers and stowed out of harm's way, and the connecting elements are recessed into openings provided for the purpose.

An especially good sealing action can be achieved by designing the sealing element as a closed ring, which extends peripherally around the containers.

An adaptation to conventional container contours is supported by the fact that the sealing element frames an essentially rectangular interior surface.

An especially high degree of mechanical strength in the sealing area is achieved by making the sealing element out of an elastomeric base material and by embedding stiffening plates into it.

So that the sealing element will be both mechanically strong and highly flexible and foldable, it is proposed that the stiffening plates be spaced a certain distance apart.

The sealing element can be held reliably in place with good mechanical strength by installing it in recesses formed in the two connected containers.

An even better sealing action can be obtained by providing a base seal in at least one of the recesses to cooperate with the sealing element.

It is possible to open and to close the container at the end surface to be connected to the other container by providing a swinging communicating door at this end of the container.

The extent to which the usable storage space available is reduced by the communicating door when it is in the open position can be minimized by installing the communicating door so that it pivots vertically upward.

The container can be handled more easily if the communicating door is designed to pivot inward around an axis of rotation into the interior space of the container.

The communicating doors can be operated in a mechanically simple yet reliable manner by providing a cable pull to move them from one position to another.

The communicating doors can be opened and closed more easily without additional help by providing a crank so that the cable pull can be actuated manually.

Especially good security against unauthorized access can be provided by designing the communicating door so that it can be locked from the inside of the container.

It is easier to ensure that the access door will lock automatically if the connecting door can be locked by at least one drop latch.

By locating the connecting element in a connecting box, in which the element is free to slide back and forth, the connecting element becomes easy to actuate, and there are no projecting parts when the connecting elements are not in use.

To ensure that all of the inventive devices are of similar design, all of the containers are provided with the same number of connecting elements and the same number of sockets, these being distributed on the end surfaces to be connected in such a way that the connecting elements are always on one side of the end surface and the connecting sockets are always on the other side or in such a way that they are always distributed diagonally on the end surface in the same way, so that any of the inventive containers can be connected to any of the other inventive containers without restriction.

The connecting and disconnecting operations can be made easier by designing the connecting element in the form of a connecting shaft with a spacer.

By providing the connecting shaft with an external thread to guide an impact nut, the containers can be clamped together in a minimal amount of time.

By providing the connecting element with an operating lever, the locking operation can be carried out with minimal expenditure of force.

High mechanical strength with simultaneous protection of the connecting elements from possibly harmful external loads is achieved by locating the connecting elements adjacent to the corner fittings of the container.

While specific embodiments of the invention have been shown and described in detail to illustrate the inventive principles, it will be understood that the invention may be embodied otherwise without departing from such principles.

DETAILED DESCRIPTION OF THE INVENTION

Figure 1:
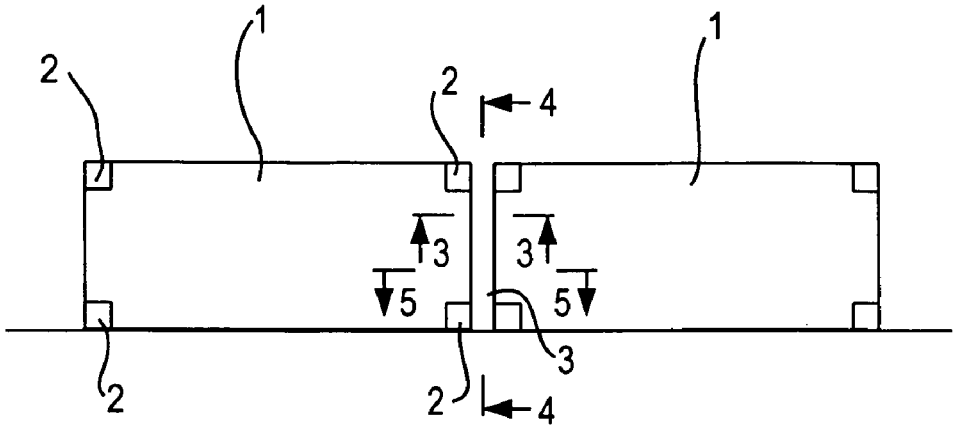
FIG. 1 shows a schematic side view of two containers, connected to each other.

FIG. 1 shows a side view of two containers 1, each of which is provided with corner fittings 2. The containers 1 are provided with a sealing element 3 which extends around the edges in the area of their facing end surfaces.

Figure 2:
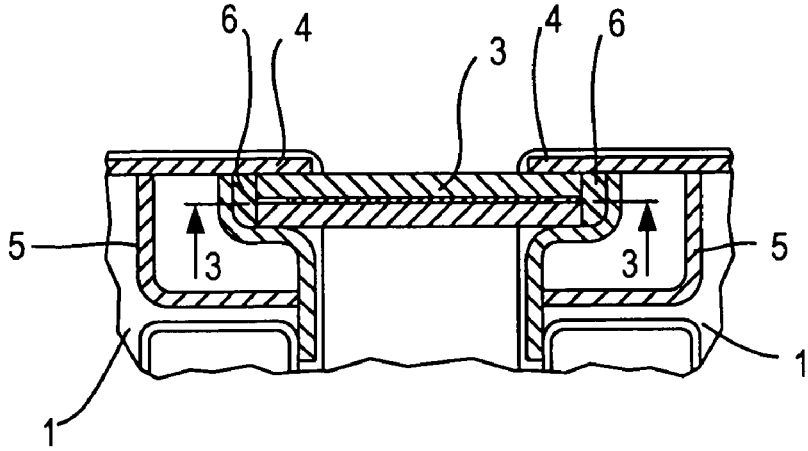
FIG. 2 shows a partial, enlarged cross section through the side posts and a sealing element.

FIG. 2 shows a partial cross section through the sealing element 3 held by the containers 1. The containers 1 are provided with groove-like recesses 4, into which the loose sealing element 3 is inserted. To increase the mechanical stability, recesses 4 are made in the corner posts 5. Base seals 6 are provided in the recesses 4. The lateral edges of the sealing element 3 are held against these base seals. Through the combination of the sealing elements 3 and the base seals 6, a reliable sealing action against the intrusion of moisture is provided, and in addition unauthorized external access to the interior spaces of the containers is prevented.

Figure 3:
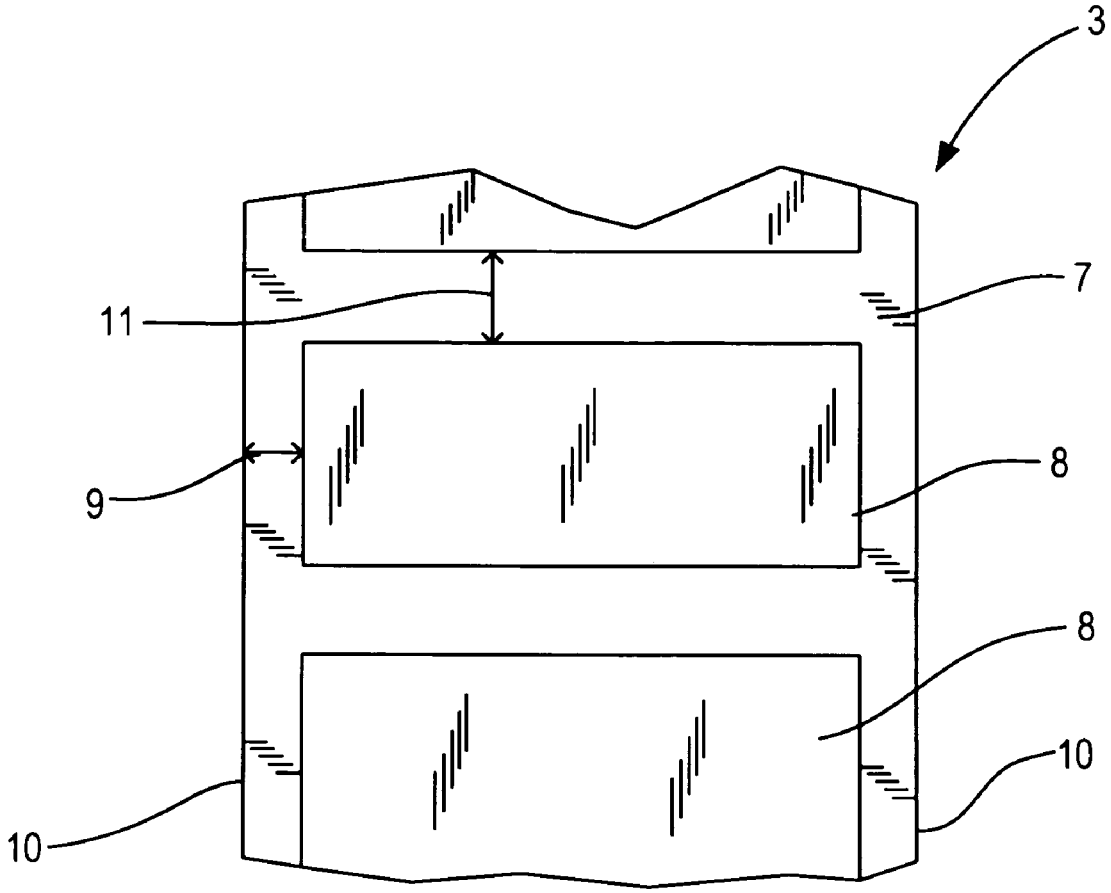
FIG. 3 shows a longitudinal cross section through the sealing element.

FIG. 3 shows a longitudinal cross section through the sealing element 3. The sealing element 3 consists of an elastomeric base material 7, in which stiffening plates 8 are embedded. The stiffening plates 8 can be made of steel, for example. To ensure a satisfactory sealing effect, the stiffening plates 8 are a certain distance 9 away from the edge 10 of the sealing element 3. In addition, the stiffening plates 8 are spaced a certain distance apart, so that the sealing element 3 is sufficiently flexible and foldable despite its considerable mechanical strength.

The combination of the stiffening plates 8 and the base material 7, as shown in FIG. 3, thus provides a highly effective sealing action, high mechanical strength, high penetration resistance, and satisfactory flexibility and foldability all at once. In particular, the stiffening plates 8 can be vulcanized into an elastomeric base material 7.

Figure 4:
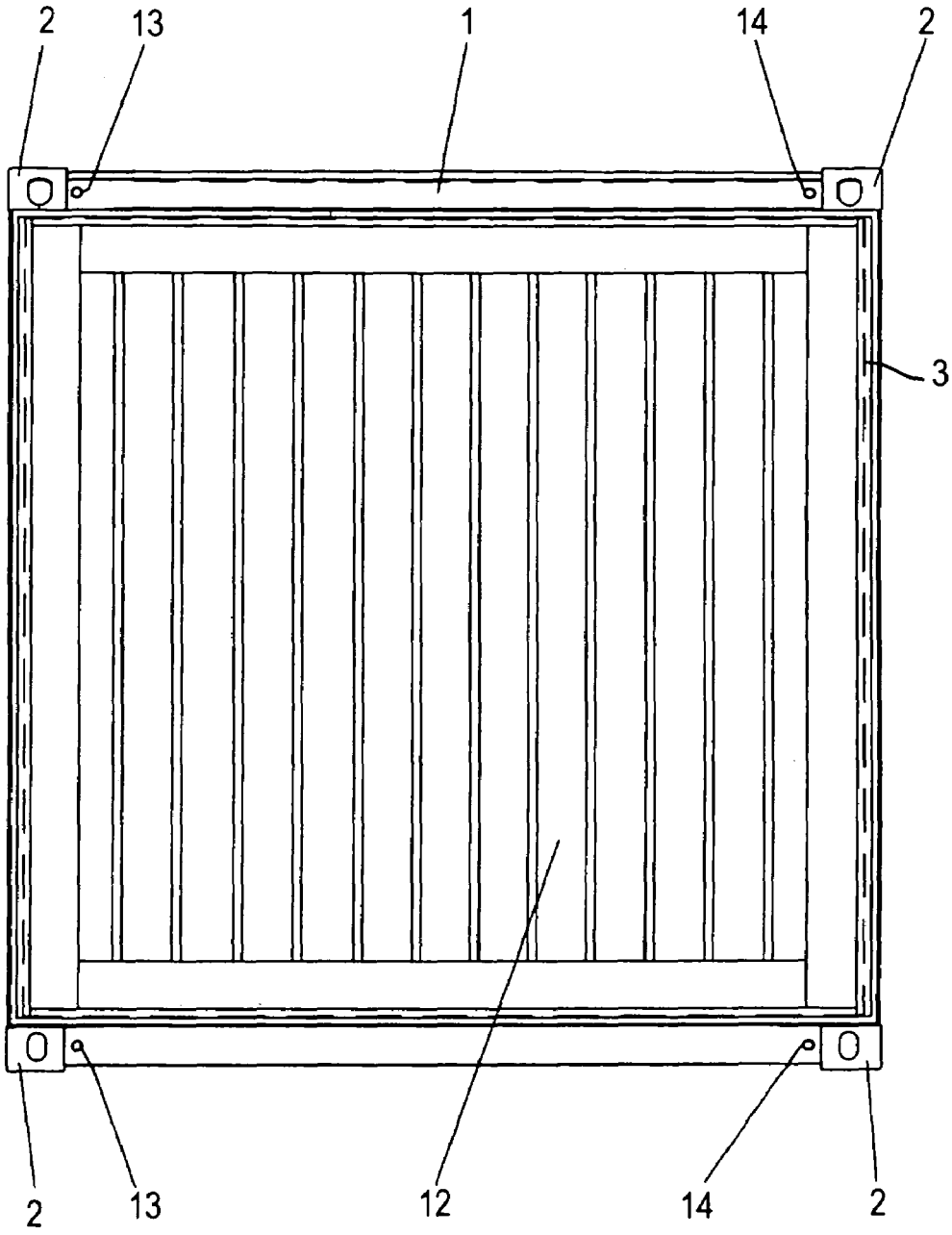
FIG. 4 shows the end surface of a container which can be connected to another container, where an adjustable door is provided in this end area.

FIG. 4 shows a side view of the container 1, which is provided with a communicating door 12 in the area of its connecting end 1. The figure also shows connecting elements 13 and connecting sockets 14 next to the corner fittings 2. In the exemplary embodiment shown here, two connecting elements 13 are provided on one side of the container and two connecting sockets 14 are provided on the other side of the container. This guarantees that, when it is desired to connect two inventive containers 1 together, it will always be possible—provided that all the containers 1 are of the same design—to introduce a connecting element 13 into an assigned connecting socket 14. As a result, any containers 1 of similar design can always be connected without additional modifications.

According to another embodiment, it would also be possible to arrange the connecting elements 13 on one diagonal on the end surface of the container and to locate the connecting sockets 14 on the other diagonal. It would be possible to design all of the containers 1 in this way, and it would thus always be possible to connect two containers 1 together easily.

Figure 4A:
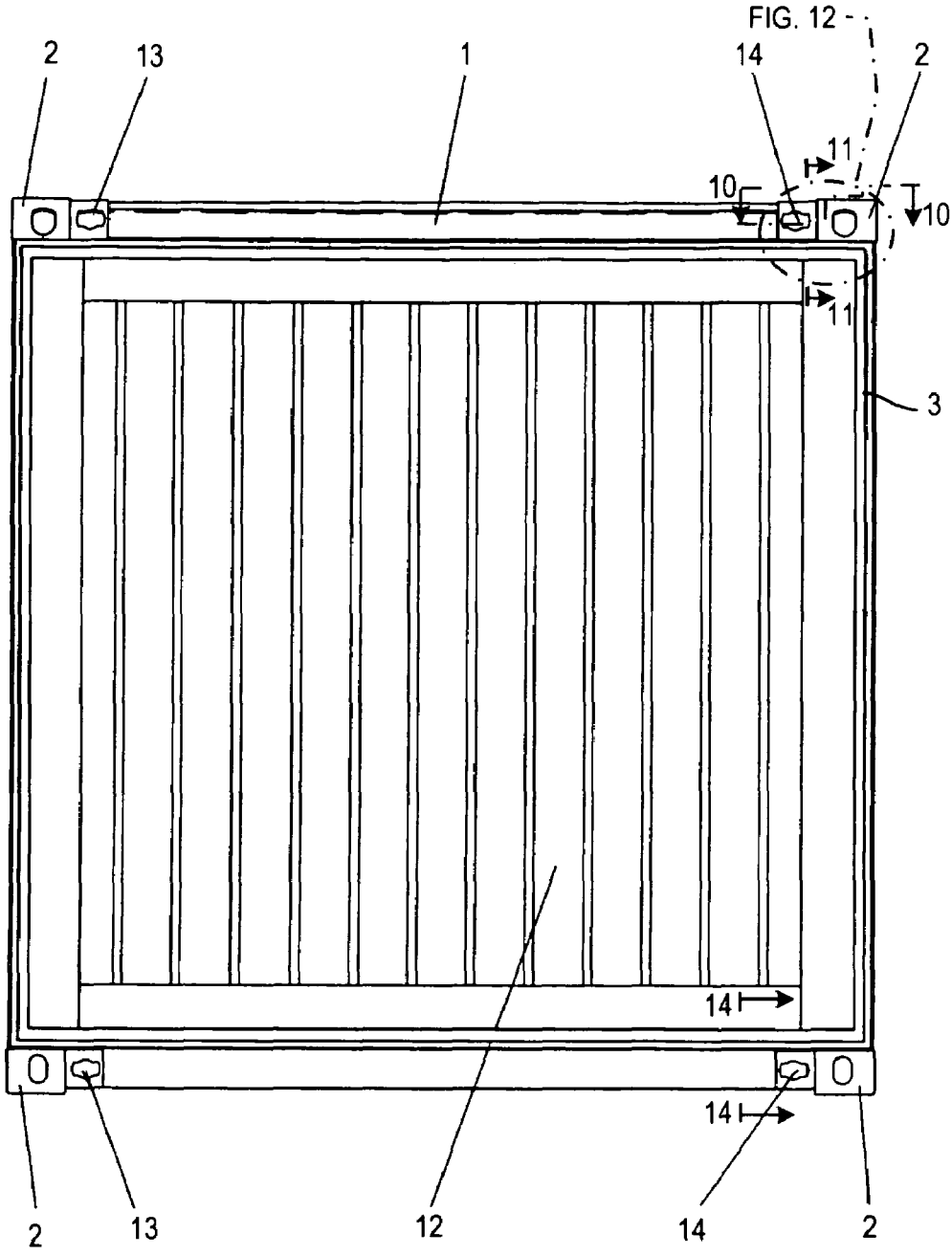
FIG. 4A is a view similar to FIG. 4 showing a sealing element as a closed ring.

FIG. 4A is a schematic side view similar to FIG. 4, showing the sealing element 3 as a closed ring.

Figure 5:
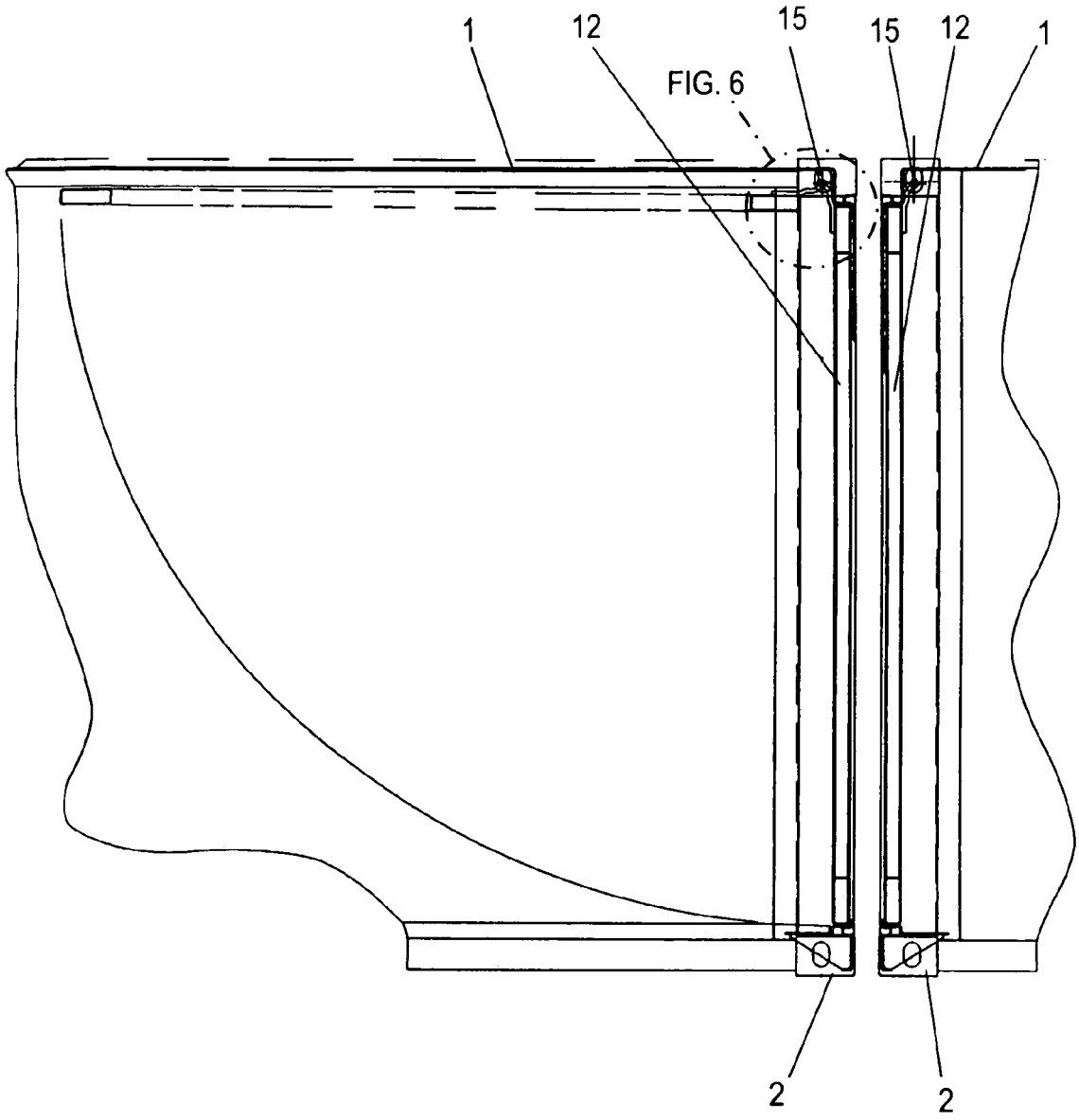
FIG. 5 shows a partial schematic cross section through two containers connected together, where one communicating door is closed and the other is swung open.

FIG. 5 shows a schematic side view of two associated containers 1, the communicating doors 12 of which are both closed. In one of the containers, broken lines show the communicating door 12 in an upward-pivoted position. The pivoting movement takes place around an axis of rotation 15 of the communicating door 12.

According to another embodiment, it would also be possible to pivot two-leaf communicating doors around a vertical axis of rotation toward the inside walls.

Figure 6:
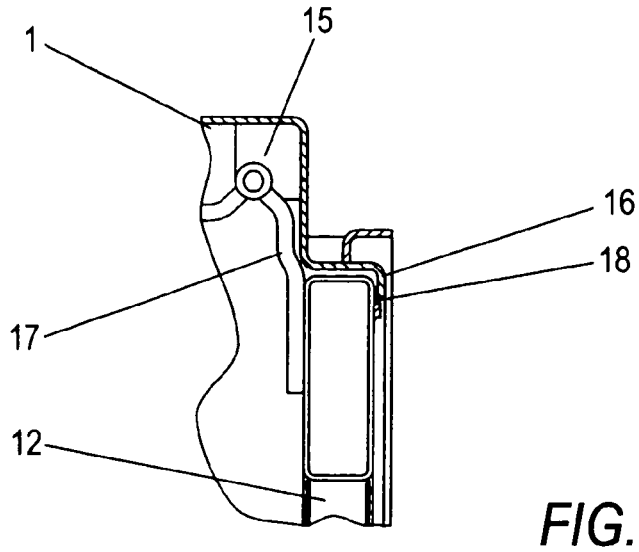
FIG. 6 shows an enlarged cross section through the area of a hinge joint of the communicating door.

FIG. 6 shows how the communicating door 12 is supported in the area of the axis of rotation 15 and where the door seal 16 is located. The communicating door 12 is supported with freedom to swing up and down by way of a connecting lever 17 in the area of the axis of rotation 15. The design of the connecting lever 17 ensures that the communicating door 12 will assume a vertical position when the container 1 is closed, and that a slight gap will remain between the communicating door 12 and the roof of the container 1 after the door has been pivoted upward. As a result, the available storage height is reduced only slightly when the communicating door 12 is swung up into its open position.

In the closed state, the communicating door 12 is held against the door seal 16. The door seal 16 is thus clamped between the downward-pivoted communicating door 12 and an outer retaining sidepiece 18. The door seal 16 is deformed elastically and thus offers a highly effective sealing action.

Figure 7:
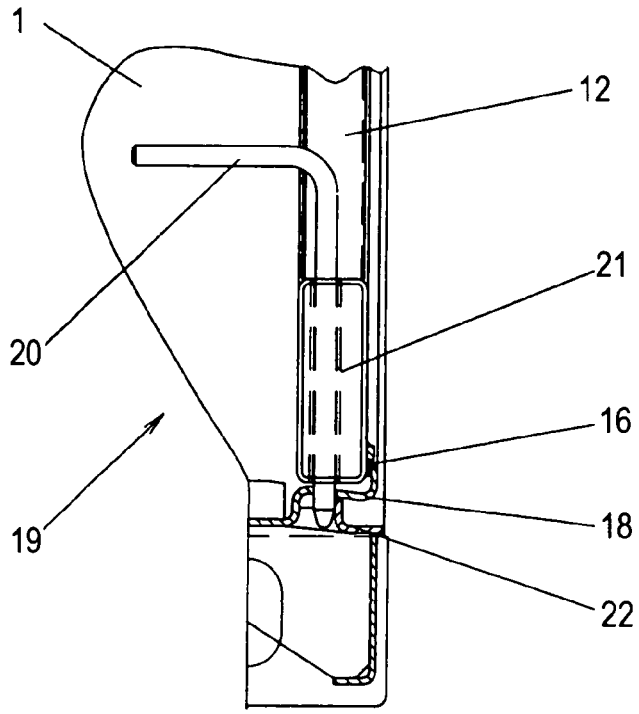
FIG. 7 shows a partial cross section through the communicating door in the area of a lower lock.

FIG. 7 shows a locking device 19 for the communicating door 12. The locking device 19 is designed as a drop latch 20, which is supported in a guide 21 in the communicating door 12. The container 1 has a locking socket 22, into which the drop latch 20 can be introduced. To unlock the door, the drop latch is manually pulled up out of the locking socket 22, and the communicating door 12 can then be swung upward. In the locking position, the drop latch 20 is held in the locking position by the force gravity alone.

Figure 8:
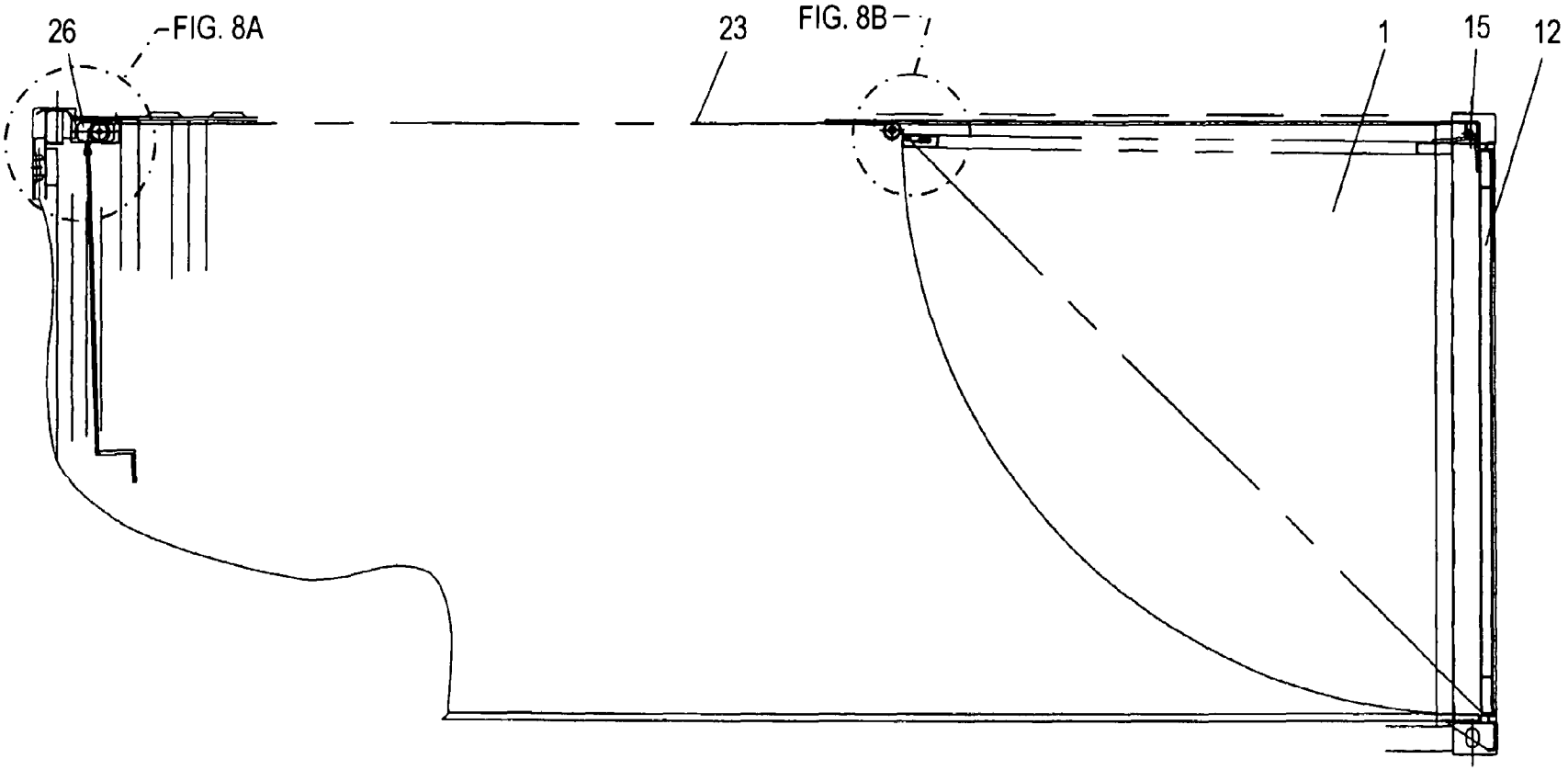
FIG. 8 shows a partial schematic longitudinal cross section through a container to illustrate an actuating device for the communicating door.
Figure 8A:
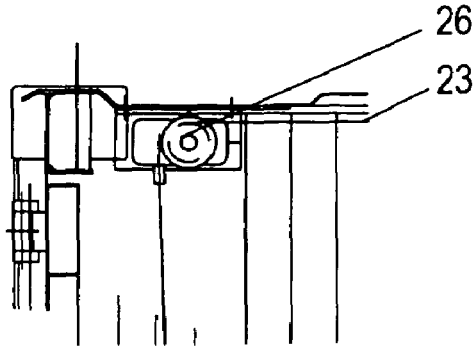
Figure 8B:
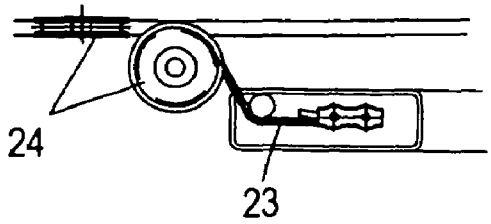

FIG. 8 illustrates schematically a mechanical actuating system for the communicating door 12. This system makes it possible to open and to close the communicating door 12 manually, without additional means. The communicating door 12 is for this purpose provided with a cable pull 23, which is guided over cable pulleys 24. A crank 15 is used to actuate a winding device 26 for the cable pull 23. When the cable pull 23 is completely wound up, the communicating door 12 is in the fully open position. By unwinding the cable pull 23, the communicating door 12 can be returned to the fully closed position.

Figure 9:
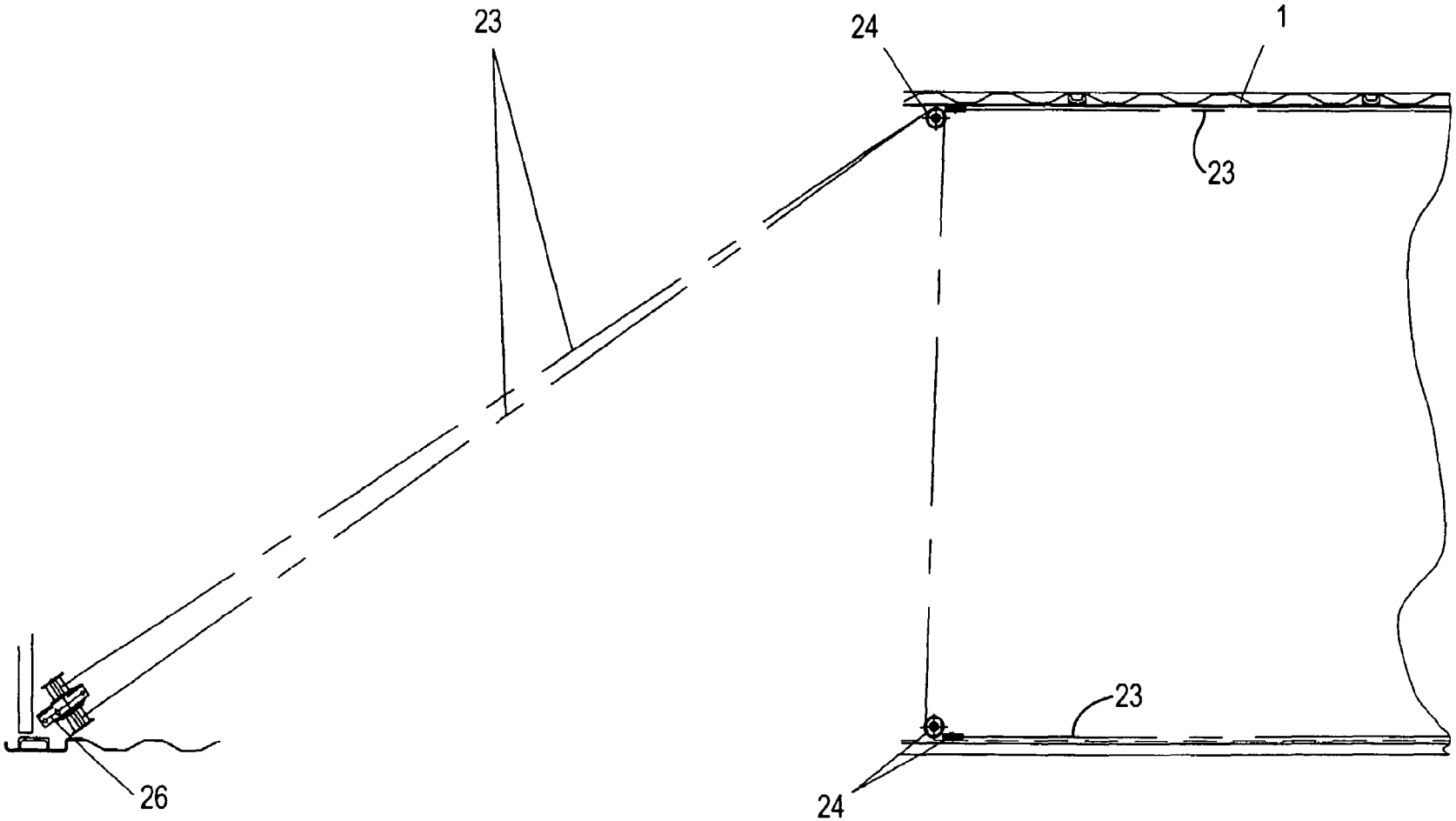
FIG. 9 shows a partial schematic plan view to illustrate the mechanism for actuating the communicating door.

FIG. 9 shows another view of the course of the cable pull 23 and the arrangement of the cable pulleys 24. It can be seen that two cable pulls 23 are attached to the communicating door 12 to ensure the uniform introduction of the pulling forces and to avoid forces which would tend to twist the door. The cable pulls 23 proceed first along the side walls of the container 1; one of the cable pulls 23 is then diverted to the opposite side of the container 1 so that both cable pulls 23 can be extended jointly to the winding device 26. The mechanical construction work is simplified by this design.

If the cable pulls 23 are joined together to form a single cable pull behind the common deflecting pulley, the winding device 26 must be located at the end of the side opposite the common deflecting pulley 24, so that the overall length of the cable pull from the common deflecting pulley to the winding device 26 will be longer than that from the common deflecting pulley to the attachment point on the door.

Figure 10:
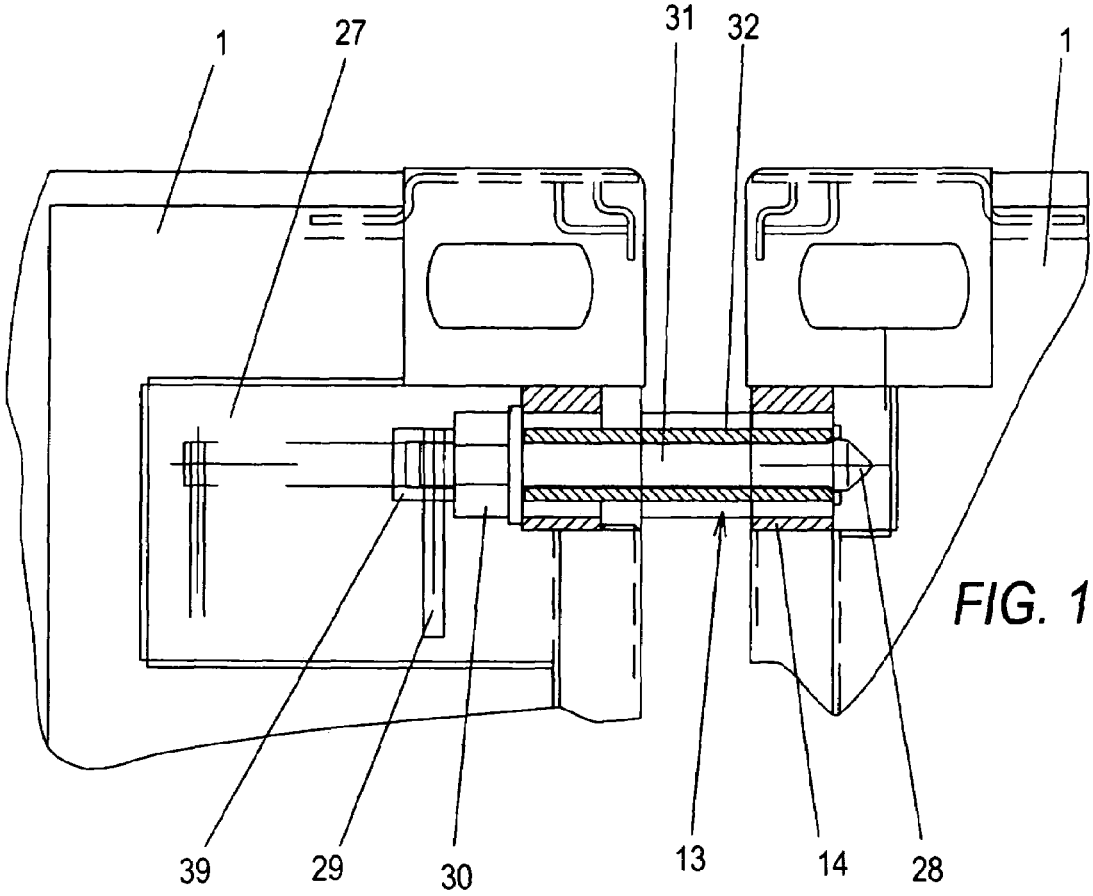
FIG. 10 shows a partial longitudinal cross section from above through a connecting element in the upper connecting area between two containers.

FIG. 10 shows two containers 1 connected to each other by the connecting element 13, the perspective being from the interior of the container toward the roof. The connecting element 13 is supported in a connecting box 27, in which the element is free to slide back and forth. In the unused state, the unused connecting element 13 is recessed within the connecting box 27. When in the locking position shown in FIG. 10, the connecting element 13 projects out from the connecting box 27, and its locking end 28 fits into the connecting socket 14. An operating lever 29 can be used to rotate the connecting element 13.

A typical locking procedure is carried out by first introducing the locking end 28 of the connecting element 13 into the connecting socket 14 and then by using the operating lever 29 to rotate the connecting element by about 90°. After this rotation, the locking end 28 is held positively in the connecting socket 14. By the use of an impact nut 30, the containers can then also be firmly fastened together.

Figure 11:
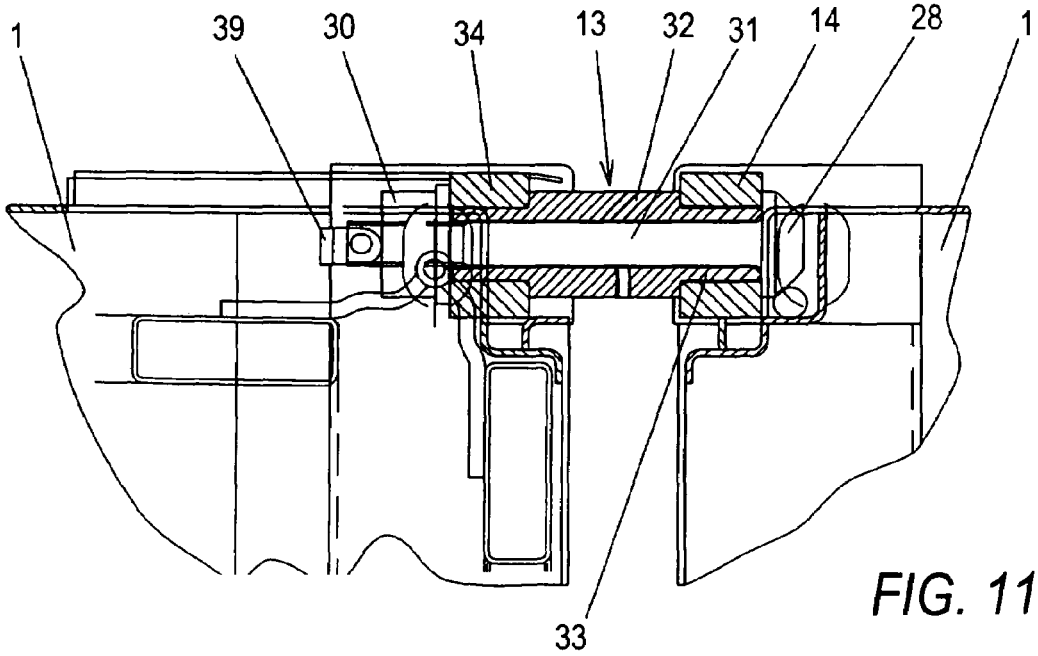
FIG. 11 shows another longitudinal cross section from the side through a connecting element in the upper connecting area between two containers.

It can be seen from the diagram of FIG. 11 that the connecting element 13 consists essentially of two parts. The locking end 28 is held by a connecting shaft 31, which extends through an essentially sleeve-shaped spacer 32. The spacer 33 is provided with an external profile 33, which determines the distance between the two containers 1 in the locked position. The connecting element 13 is guided in the area of the connecting box 27 by an element holder 34. The element holder 34 is rigidly connected to the connecting box 27. A lock nut 39 is located behind the impact nut 30.

Figure 12:
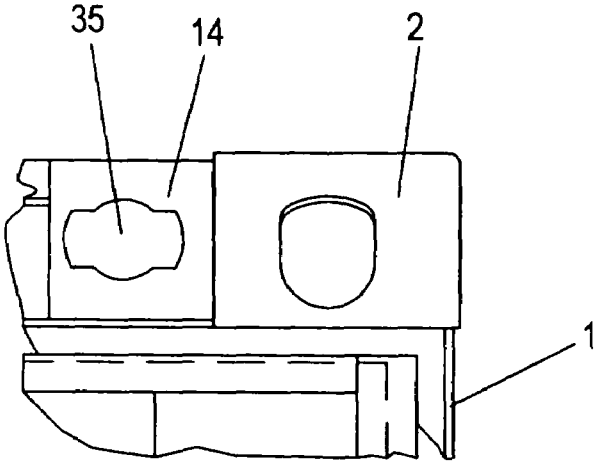
FIG. 12 shows a side view of a socket for a connecting element, the socket being located next to a conventional corner fitting.
Figure 13A:
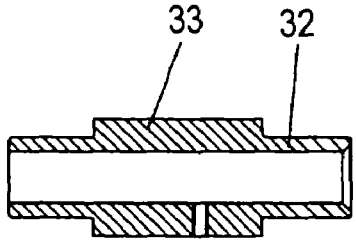
FIG. 13 shows the design of the individual components of the connecting element from each of two different perspectives.
Figure 13B:
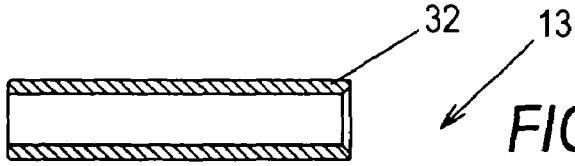
Figure 13C:
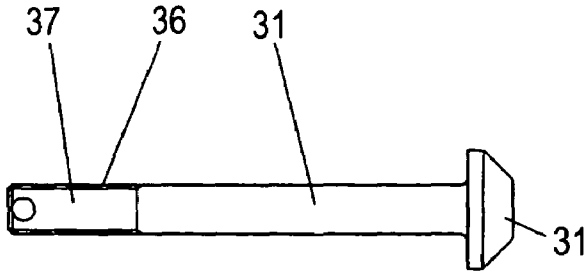
Figure 13D:
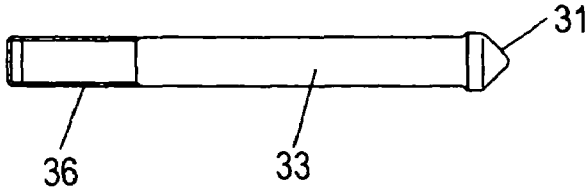

FIG. 12 shows a side view of the connecting socket 14 located next to the corner fitting 2. It can be seen that the connecting socket 14 has an insertion opening 35, which is designed in such a way that the locking end 28 can be pushed into the insertion opening when it is in a first position but cannot be pulled back out of the insertion opening 35 after it has been rotated by approximately 90° into a second position. By means of a design of this type, the locking and unlocking operations can be carried out very quickly, whereas a high mechanical load-bearing capacity is obtained at the same time.

FIG. 13 shows the design of the connecting element 13 after the connecting shaft 31 has been separated from the spacer 32. To be seen in particular is the design of the locking end 28, which, in one of the positions shown, can be introduced into the insertion opening 35, whereas, when in the other position, it cannot be pulled out of the opening 35. It can also be seen that the spacer 32 is essentially in the form of a sleeve and has a rotationally symmetric external profile 33. It can also be seen that the connecting shaft 31 has an external thread 36, which is designed to cooperate with a corresponding internal thread of the impact nut 30. In the area of the external thread 36, the connecting shaft 31 is provided with a bore 37, which accepts the operating lever 29.

Figure 14:
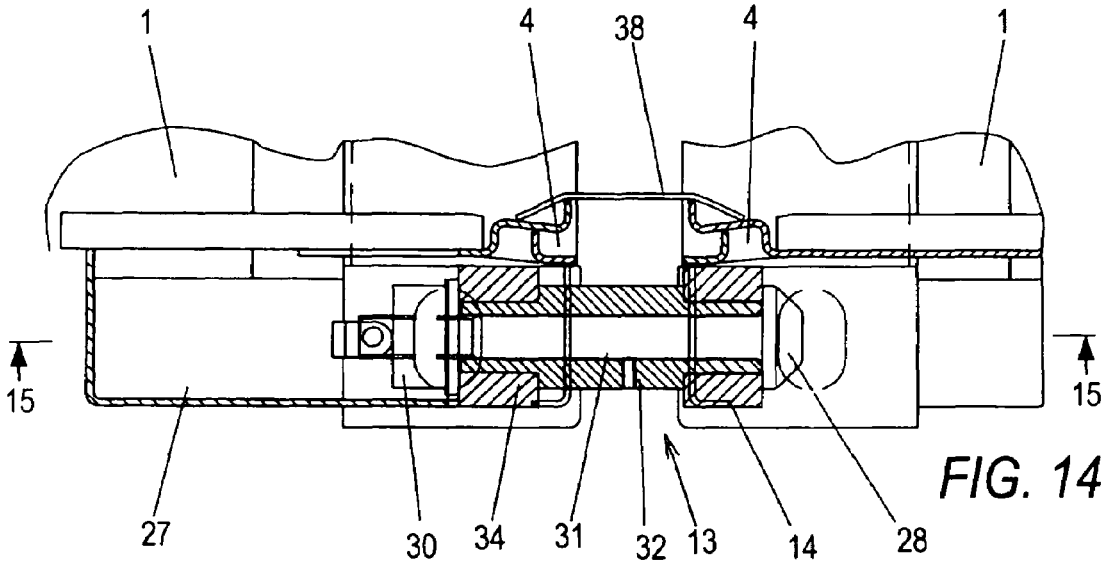
FIG. 14 shows another longitudinal cross section from the side through a connecting element in the lower connecting area between two containers.

FIG. 14 shows the arrangement of the connecting element 13 in a lower bottom area of the container 1. An additional cover plate 38 is mounted over the recesses 4 for the sealing element to protect against external mechanical damage.

Figure 15:
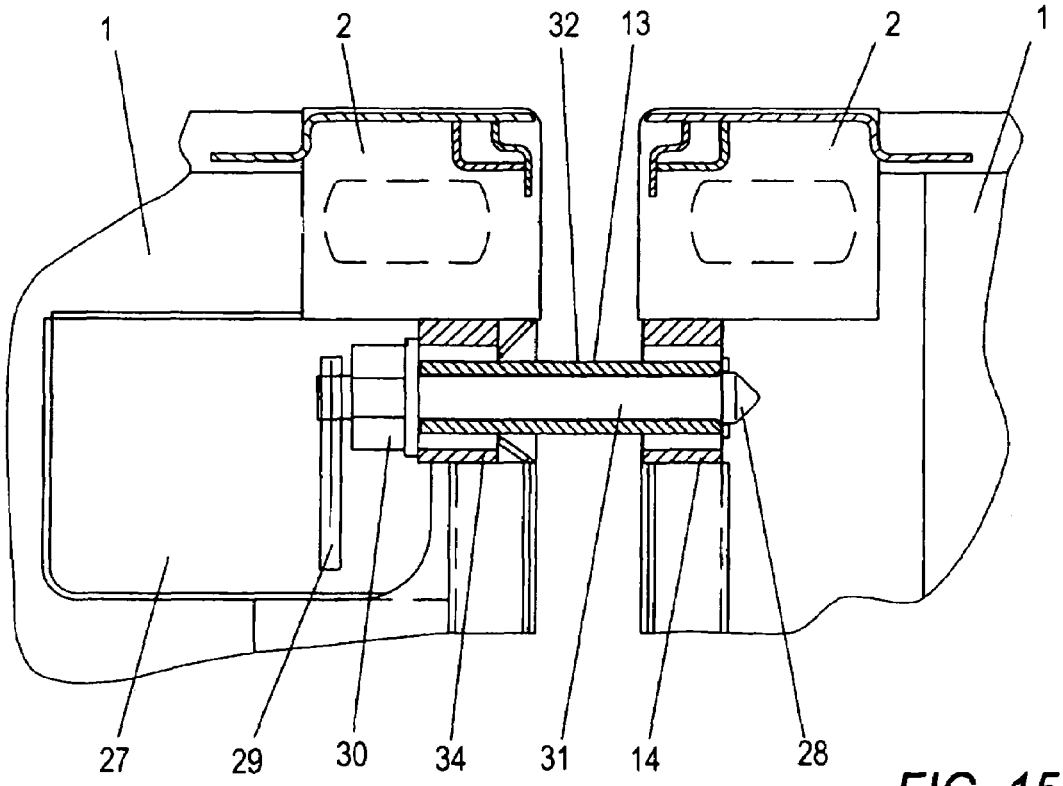
FIG. 15 shows another longitudinal cross section from above through a connecting element in the lower connecting area between two containers.

FIG. 15 shows again the arrangement of the connecting box 27 and of the connecting socket 14 next to the associated corner fittings 2 in the lower part of the container. Positioning the components in the interior next to the corner fittings 2 provides a considerable degree of mechanical strength.

Figure 16:
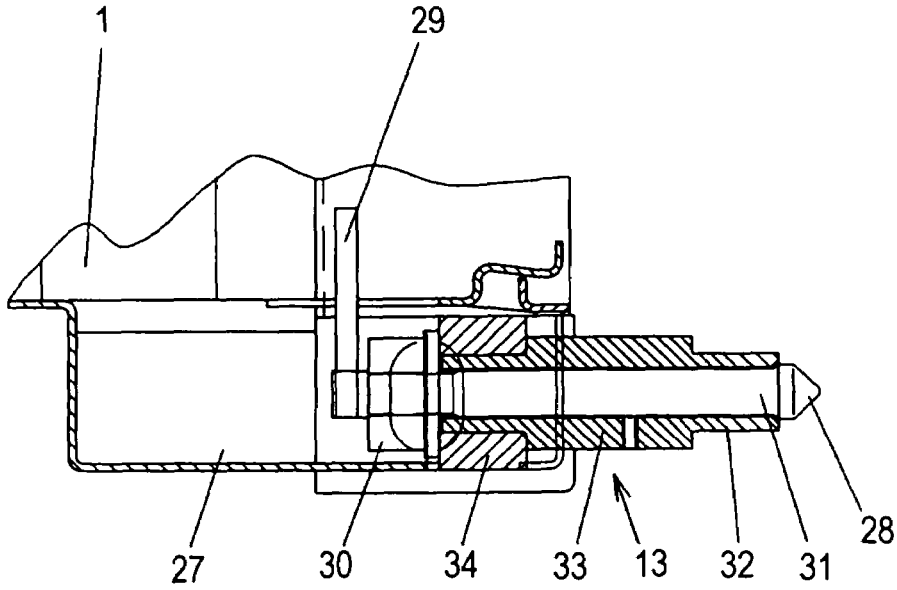
FIG. 16 shows another longitudinal cross section from the side through a connecting element in the lower connecting area in the unlocked state shortly before the connecting operation.

FIG. 16 shows a partial cross section of a container 1, where the connecting element 13 has been pushed out of the connecting box 27.

Two containers 1 can be connected to each other in the following manner. First, the containers 1 are arranged with their communicating doors 12 facing each other. The distance between them is selected typically so that, in a first step, the edge sealing element 3 can be inserted into the associated recess 4 in one of the containers 1. Then the containers 1 are pushed together in such a way that the connecting elements 13 can be pushed into their assigned connecting sockets 14. During this step, it is preferable for at least one of the communicating doors 12 to be open, so that the sealing element 3 can be supported or guided from the inside as it is being introduced into the second recess 4.

After the containers 1 have been brought together in the proper position, the connecting elements 13 are rotated into their locking positions, and then, with the use of the impact nuts 30, the containers are then also clamped firmly together. The containers 1 are disconnected from each other by performing these same steps in reverse order.

The locking device 19 is preferably designed in such a way that it can be actuated only from the interior of the container 1. A design of this type offers the advantage that it is impossible to open the communicating door from the outside.

Figure 17:
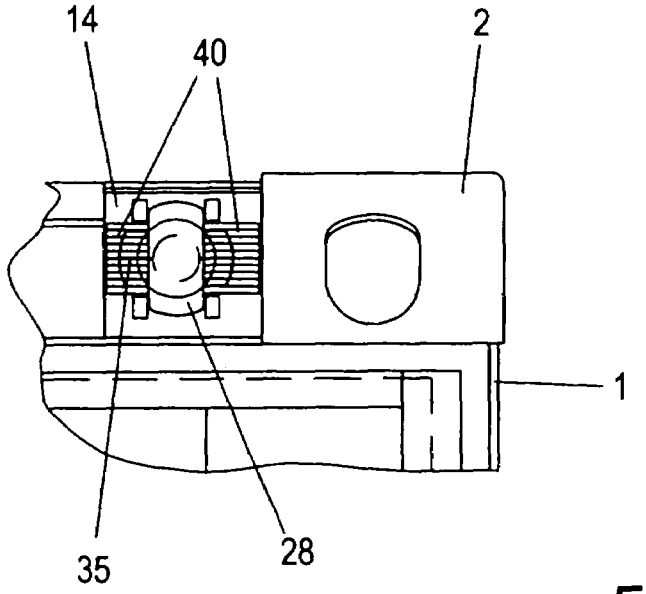
FIG. 17 shows a cross section in the area of an upper connecting element with a sealing element next to a corner fitting.

FIG. 17 shows the use of a sealing element 40 in the area of an upper connecting socket 14. This element is designed as a rubber flap, which prevents the intrusion of water or moisture into the interior of the container 1 through the parts of the connecting socket 14 next to the circular part.

While specific embodiments of the invention have been shown and described in detail to illustrate the inventive principles, it will be understood that the invention may be embodied otherwise without departing from such principles.

I claim:

1. Device containers for holding freight, comprising two containers connected to each other by at least two connecting elements, wherein the containers, in the area where they are connected, are sealed off from the environment by at least one sealing element, wherein each of the containers has a closable access opening at an end which faces the other container, wherein the sealing element (3) extends around outside edges in the area of the facing ends of the containers (1), and wherein a connecting element (13) is installed on the container (1) in such a way that, when the containers are not attached to each other, the external contour of the connecting element (13) is located in an essentially interior position with respect to the external contour of the container (1), wherein the sealing element (3) is made of an elastomeric base material (7) in which stiffening plates (8) are embedded.

2. The device according to claim 1, wherein the sealing element (3) is a closed ring extending around the area of the outside edges.

3. The device according to claim 1, wherein the sealing element (3) frames an essentially rectangular inner surface.

4. The device according to claim 1, wherein the stiffening plates (8) are a certain distance (11) apart.

5. The device according to claim 1, wherein the sealing element (3) is held in recesses (4) in the containers (1).

6. The device according to claim 5, wherein a base seal (6) is located in at least one of the recesses (4) to cooperate with the sealing element (3).

7. The device according to claim 1, wherein a two-part pivoting communicating door (12) is located in the area of the access opening.

8. The device according to claim 7, wherein the communicating door (12) can be pivoted vertically upward.

9. The device according to claim 7, wherein the two-part communicating door (12) can be pivoted toward the sides.

10. The device according to claim 7, wherein the communicating door (12) is mounted so that it can be pivoted around an axis of rotation (15) into the interior space of the container (1).

11. The device according to claim 1, wherein the communicating door (12) can be positioned by a cable pull (23).

12. The device according to claim 11, wherein the cable pull (23) can be actuated manually by means of a crank.

13. The device according to claim 1, wherein the communicating door (12) can be locked from the interior of the container (1).

14. The device according to claim 1, wherein the communicating door (12) can be locked by at least one drop latch (20).

15. The device according to claim 1, wherein the connecting element (13) is mounted in a connecting box (27) in which it is free to slide back and forth.

16. The device according to claim 1, wherein each container (1) has the same number of connecting elements (13) and connecting sockets (14).

17. The device according to claim 1, wherein each container has the same number of connecting elements and connecting sockets, which are distributed on an end surface to be connected in such a way that the connecting elements are always on one side and the connecting sockets are always on the other or so that the connecting elements and the sockets are always distributed diagonally in the same way.

18. The device according to claim 1, wherein the connecting element (13) is comprised of a connecting shaft (31) and a spacer (32).

19. The device according to claim 18, wherein the connecting shaft (31) is provided with an external thread (36) to guide an impact nut (30).

20. The device according to claim 1, wherein the connecting element (13) is provided with an operating lever (29).

21. The device according to claim 1, wherein the connecting element (13) is adjacent to a corner fitting (2) of the container (1).

22. The device according to claim 1, wherein at least one sealing element (40) is provided in the area of at least one upper connecting socket (14).

* * * * *